United States Patent [19]

Kozacka

[11] 4,078,221

[45] Mar. 7, 1978

[54] LOAD-BREAK SWITCH AND CURRENT-LIMITING FUSE COMBINATION

[75] Inventor: Frederick J. Kozacka, South Hampton, N.H.

[73] Assignee: Gould, Inc., Newburyport, Mass.

[21] Appl. No.: 757,449

[22] Filed: Jan. 6, 1977

[51] Int. Cl.[2] ..... H01H 71/20

[52] U.S. Cl. ..... 337/168; 337/171; 337/173

[58] Field of Search ..... 337/168, 169, 170, 171, 337/173

[56] References Cited

U.S. PATENT DOCUMENTS 2,816,985 12/1957 Lindell ..... 337/169 X

*Primary Examiner*—George Harris

*Attorney, Agent, or Firm*—Erwin Salzer

[57] ABSTRACT

Load-break switches and current-limiting fuses are often serially connected and placed one above the other. This arrangement is relatively bulky, and involves in particular relatively large requirements in respect to height.

The present invention concerns an arrangement of parts wherein the load-break disconnect and the current-limiting fuse are electrically connected in series, but wherein they are arranged spatially in parallel, substantially in coaxial relation, the load-break switch or some of its constituent parts being arranged inside of the current-limiting fuse; or the load-break switch and the current-limiting fuse may be provided with contact means common to both of them.

7 Claims, 4 Drawing Figures

LOAD-BREAK SWITCH AND CURRENT-LIMITING FUSE COMBINATION

BACKGROUND OF THE INVENTION

This invention contemplates a series device of load-break switch and current-limiting fuse, wherein the switch is to break load currents and small overload currents, i.e. currents not exceeding a small multiple of the rated current of the load-break switch, all fault current of higher magnitude being handled by the current-limiting fuse. In other words, the current-limiting fuse is relieved under such circumstances from interrupting relatively small overload currents. This greatly simplifies the design of the current-limiting fuse as compared to an all purpose current-limiting fuse which must be capable of interrupting the full range of currents, from the smallest overload current to the largest fault current. It has been observed that under the contemplated conditions but a relatively small portion of the pulverulent arcquenching filler of the fuse is converted into a fulgurite. This means that the portion not coverted into a fulgurite represents, at best, an unnecessary safety factor which can readily be dispensed with. The space gained by reducing the volume of arcquenching filler can be used to accommodate a load-break disconnect, or at least a part of its operating mechanism.

SUMMARY OF THE INVENTION

A load-break switch and current-limiting fuse combination embodying the present invention includes a load-break switch having relatively movable contacts, a current-limiting fuse having a casing including a pair of spaced walls defining a space therebetween whose cross-section is annular and houses the fusible elements and the granular arc-quenching filler of the fuse. The operating mechanism for the switch is arranged at least in part inside the inner wall of said casing of said fuse.

DESCRIPTION OF PREFERRED EMBODIMENTS

Figure 1:
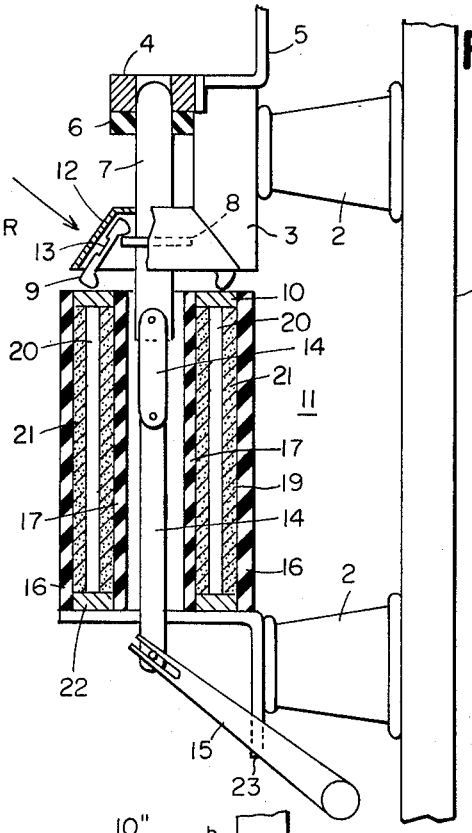
FIG. 1 shows partly in longitudinal section and partly in elevation a first embodiment of the invention.

Referring now to FIG. 1, character 1 has been applied to indicate a fixed frame structure to which the supporting insulators 2 are affixed. The upper supporting insulator 2 supports an insulating member 3 which, in turn, supports the fixed tulip-type contact 4 with the terminal 5 and the sleeve of gas-evolving material 6. The fixed tulip-type contact 4 is engaged by the coaxial movable rod-type contact 7 being provided with the collar 8. A number of finger contacts 9 is arranged in a circular pattern around the collar 8, each being angularly displaced with respect to its two neighbors. One end of finger contacts 9 rests upon collar 8 and their opposite end rests against an annular terminal element 10 of a current-limiting fuse, generally indicated by reference numeral 11. A hood 12 in the shape of a trunc of a cone 12 covers the assembley of finger contacts 9. Each of finger contacts 9 is provided with a recess 13. A helical spring (not shown) is clamped between finger contacts 9 and hood 12. The direction of the action of these springs has been indicated by the arrow R. Thus the ends of finger contacts 9 are clamped against parts 8 and 10 and transfer current from rod contact 7 to terminal element 10. The lower end of rod contact 7 is affixed to two toggle links 14 which are operated by the slotted operating lever 15. Lever 15 may be operated manually. It may be under the action of over-center springs (not shown) to cause separation and engagement of contacts 4 and 7 with a snap action. If desired, the switch may also be provided with a tripping device (not shown) to cause automatic opening and closing thereof on fault and overload currents. Linkages 14 may be made of electric insulating material since they are not current-carrying.

The current-limiting fuse 11 includes the radially outer insulating wall 16 and the radially inner insulating wall 17 defining a space of annular cross-section 19 therebetween. This space 19 houses the fusible elements 20, and the granular arc-quenching filler 21 of the current-limiting fuse 11. The upper ends of the fusible elements 20 are conductively connected to the aforementioned annular terminal element 10 and the lower end of the fusible elements 20 are conductively connected to annular terminal element 22 closing the lower end of casing 16,17.

The current path of the above device is as follows: terminal 5, tulip-type contact 4, movable rod contact 7, collar 8, contact fingers 9, terminal element 10, fusible elements 20, terminal element 22, and terminal 23.

Small over-currents result in manual or automatic separation of contacts 4 and 7. The resulting arc is quenched by elongation thereof coupled with the evolution of gas from sleeve 6. Large currents cause transformation of fusible elements 20 into fulgurites which when cold insulate the two terminal elements 10 and 22 from one another.

Figure 2:
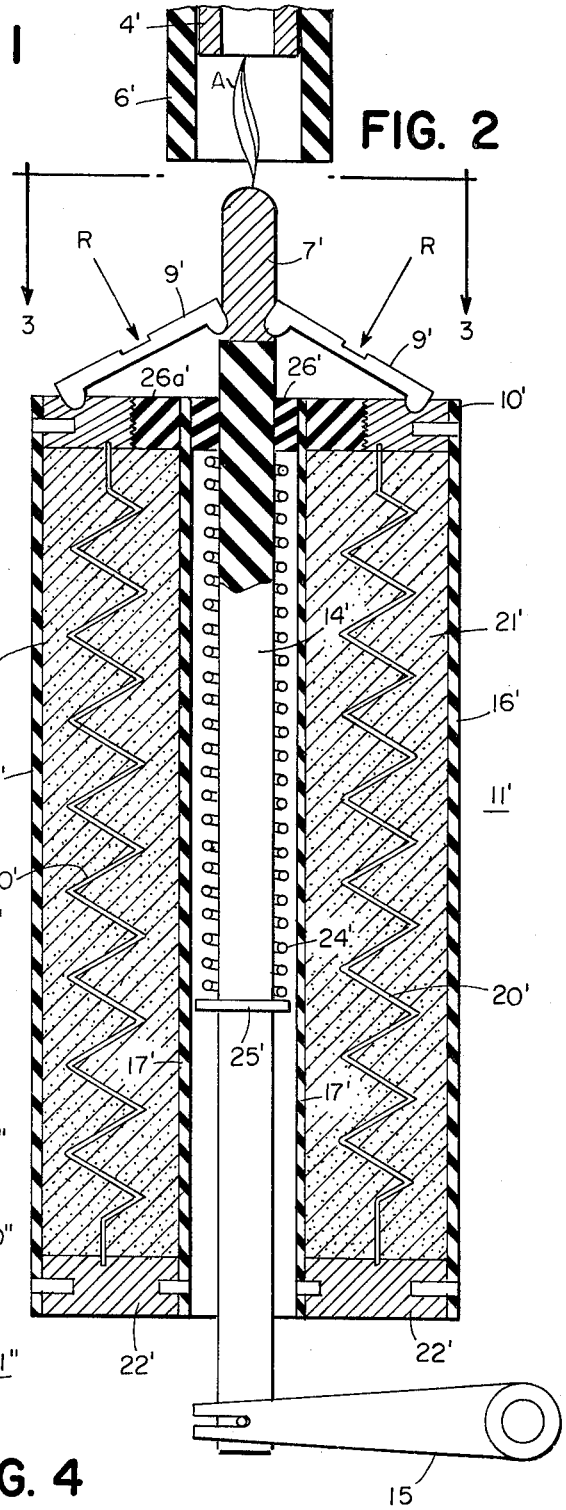
FIG. 2 shows partly in longitudinal section and partly in elevation a second embodiment of the invention.

The same numerals with a prime added have been applied in FIG. 2 to indicate like parts as in FIG. 1. Thus tulip-type finger contacts 4′ are surrounded by sleeve 6′ of gas-evolving material. Rod contact 7′ is separated from finger contacts 4′ and an arc A has been drawn therebetween. Rod contact 7′ is permanently conductively connected by finger contacts 9′ with the upper annual terminal 10′ of fuse 11′. Finger contacts 9′ are acted upon by springs (not shown) whose direction of action has been indicated by the arrows R. The fusible elements 20′ are immersed in the pulverulent arc quenching filler 21′ and enclosed in a space bounded by coaxial walls 16′ and 17′. The upper end of this space is closed by terminal element 10′ and its lower end by terminal element 22′. Fusible elements 20 are zig-zag-shaped to minimize the effects of thermal expansion and compression. The central space of fuse 11′ whose cross-section is circular contains a rod 14′ of electric insulating material which forms a coaxial extension of metal contact 7′. Rod 14′ is surrounded by a helical spring 24′ of which one end rests against a collar 25′ and the other end rests against a plug 26′ of electric insulating materials arranged between annular part 17′ and 7′. Thus spring 24′ biases contact 7′ and rod 14′ in downward, or open circuit, position. A tripping device controlled latch (not shown) may maintain the breaker in the closed position thereof. For closing the breaker lever 15′ is rotated in clockwise direction, as seen in FIG. 2, until rod 14′, or an equivalent part, is relatched.

Figure 3:
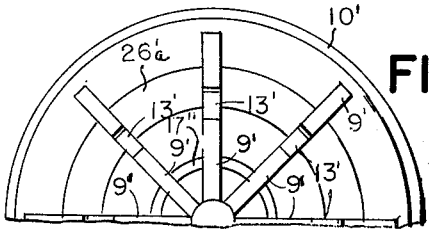
FIG. 3 is a partial top-plan view of the device of FIG. 2 taken along section 3—3 of FIG. 2.

The current path of the device of FIGS. 2 and 3 is as follows: fixed contact 4', movable contact 7', finger contacts 9', upper fuse terminal plug 10', fusible elements 20', lower fuse terminal plug 22'. From there the current may be transferred to a terminal as shown in FIG. 1.

Figure 4:
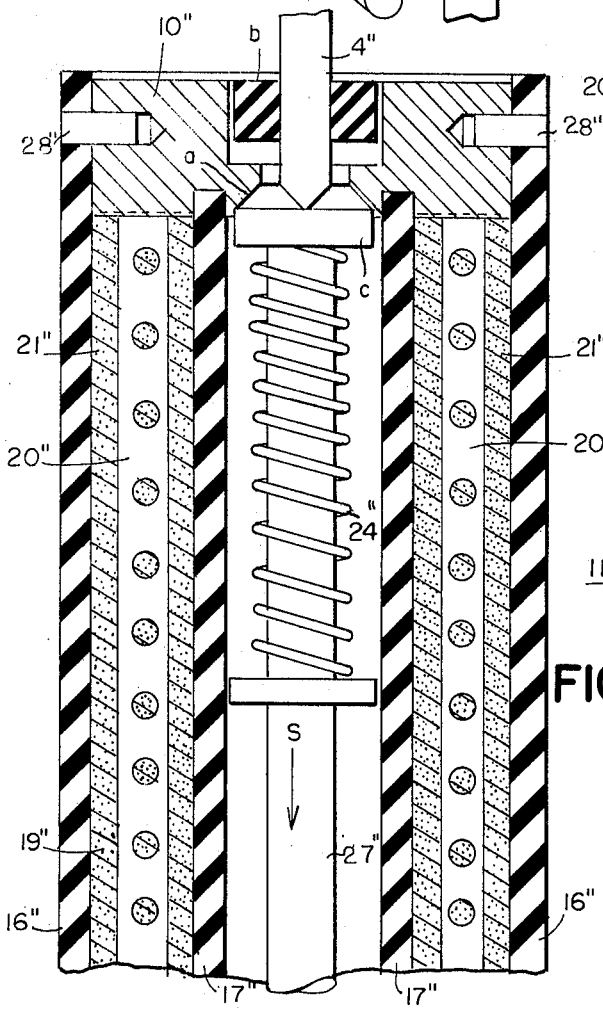
FIG. 4 shows partly in longitudinal section and partly in elevation a third embodiment of the invention.

The structure of FIG. 4 differs from that of FIGS. 1–3 in that virtually the entire load break disconnect is housed in the casing of the fuse. This is possible in instances where the line voltage is relatively moderate, and does not require relatively substantial insulating gaps.

FIG. 4 shows but the upper portion of a fuse since the design of the lower portion is obvious. Like parts have been applied in FIG. 4 with the same reference characters as in FIGS. 1 and 2, with two primes added. Thus the current-limiting fuse 11" includes a pair of coaxial spaced walls 16" and 17" defining a space 19" of annular cross-section therebetween. Reference numerals 20" have been applied to indicate the fusible elements formed by ribbons having circular perforations, and reference numeral 21" has been applied to indicate the granular arc-quenching filler surrounding the fusible element 20". The casing of the fuse is closed at its top and at its bottom by annular terminal elements. The top is closed by an annular terminal element 10" which forms the contact surfaces *a*. The fixed rod-shaped contact 4" extends through an insulating gland *b* into engagement with movable contact *c*. Contact *c* is spring-biased in upward direction and interconnects in the position shown in FIG. 4 conductively contacts *a* and 4". When contact *c* is withdrawn in the direction S against the bias of spring 24", contact 4" bridges no longer contacts 4" and 10", thus interrupting the series connection between the disconnect contacts 4", *c*, 10" and the current-limiting fuse.

The present device is intended to be applied in instances where the making and breaking of the circuit by the load break switch exceeds the number of operations of the current-limiting fuse. The excess of one kind of operation over the other kind must, however, stay within certain limits. If the number of operations of the load break switch is relatively large and/or a relatively severe operating duty is imposed upon the switch contacts thereof, then it is necessary to provide separate current-carrying contacts and arcing contacts, as generally done in the art.

It will be understood that the nature of the tripping device depends upon the nature of the actuating device with which the switches embodying this invention are provided. Electromagnetic actuation calls for a bimetal strip, or a solder pot, to de-energize the circuit of the electromagnet. Similar tripping devices may be used if the operating mechanism of the trip-free-from- the-handle-type.

In the embodiment of FIG. 4 contact *c* has a certain play, i.e. it may move relative to insulating rod 27" against the action of spring 24". On closing of contact *c*, i.e. bridging contacts 4" and 10", contact *c* moves in downward direction a predetermined relatively short distance relative to rod 27". On separating contact *c* from contacts 4" and 10", contact *c* performs a limited travel relative to rod 27" before it separates from contacts 4" and 10". It will thus be apparent that the function of spring 24" is not to separate contact *c* from contacts 4" and 10", but to provide a flexible cushion for contact *c*". Hence the load-break switch must be provided with additional means, e.g. spring means, that move rod 27" in downward direction. It is this latter spring which is under the control of a thermal or equivalent tripping device. Since thermal tripping devices have a given limit temperature as a result of their limited heat absorbing capacity, the current-limiting fuse must take over at higher current values than said critical current which produces said limit temperature.

In FIG. 4 reference numeral 28" has been applied to indicate so-called roll pins by which casing 16" is affixed to contact 10". If desired, the radially inner casing 17" may be affixed to contact 10" in like fashion.

I claim as my invention:

1. In a load-break switch and current-limiting fuse combination, the combination of (a) a load-break switch having relatively movable contacts;

(b) a current-limiting fuse electrically connected in series with said load-break switch, said current-limiting fuse having a casing including a radially outer insulating wall and a coaxial radially inner insulating wall defining a space of annular cross-section therebetween, the fusible elements and the granular arc-quenching filler of said current-limiting fuse being arranged inside said space of annular cross-section; and (c) an operating mechanism for said load-break switch arranged at least in part inside of said radially inner insulating wall of said current-limiting fuse.

2. In a load-break switch and current-limiting fuse combination, the combination of (a) a load-break switch having a fixed tulip-type contact and a movable rod-shaped contact;

(b) a current-limiting fuse electrically connected in series with said load-break switch, said current-limiting fuse having a casing comprising a pair of equidistantly spaced insulating walls housing between said insulating walls thereof fusible elements and an arc-quenching filler, and said casing being further closed on both ends thereof by annular terminal elements;

(c) a permanent electric connection between said movable contact of said load-break switch and one of said annular terminal elements; and (d) an operating mechanism for said movable contact of said load-break switch arranged at least in part inside said casing beyond the radially inner of said insulating walls thereof.

3. A load-break switch and current-limiting fuse combination as specified in claim 1 wherein said permanent electric connection between said movable contact of said load-break switch and said one of said annular terminal elements is achieved by a plurality of pivotable finger contacts, arranged in a tulip-type pattern each having one end thereof spring-biased against said annular terminal element and the other end thereof spring-biased against said movable rod-shaped contact.

4. A load-break switch and current-limiting fuse combination as specified in claim 2 wherein a helical spring biasing said movable contact of said load-break switch to the open position thereof is arranged inside said casing of said current-limiting fuse in coaxial relation thereto.

5. In a load-break switch and current-limiting fuse combination, the combination of (a) a load-break switch having a first fixed rod-type contact, a second fixed annular contact arranged in coaxial relation to said first rod-type contacts and a movable tertiary contact arranged to conductively interconnect and to break the interconnection between said first rod-type contact and second annular contacts;

(b) a current-limiting fuse having a casing including a pair of spaced walls, said casing housing between said walls thereof fusible elements and a granular arc-quenching filler, and said casing being closed by said second annular contact at one of the ends thereof; and (c) a helical spring arranged in coaxial relation inside said casing beyond the inner wall thereof biasing said tertiary contact into engagement with said rod-type contact and with said second annular contact.

6. In a load-break switch and current-limiting fuse combination, the combination of (a) a current-limiting fuse having a casing including a pair of spaced walls housing in the space defined by said walls fusible elements and a granular arc-quenching filler;

(b) a pair of annular terminal elements closing the ends of said casing and conductively interconnected by said fusible elements; and (c) a load-break disconnect connected in series with said current-limiting fuse, said load-break disconnect having a stationary tulip-type contact and a movable rod-type contact cooperating therewith arranged substantially in coaxial relation with said casing of said current-limiting fuse, and said housing of said current-limiting fuse accommodating in the space beyond the inner of said spaced walls at least a portion of the operating mechanism of said movable rod-type contact of said load-break disconnect.

7. In a load-break switch and a current-limiting fuse combination, the combination of (a) a load-break disconnect having a first fixed rod-type contact, a second fixed annular contact arranged in coaxial relation with said fixed rod-type contact and a movable tertiary contact arranged to conductively interconnect and to sever the interconnection between said fixed rod-type contact and said second fixed annular contact; and (b) a current-limiting fuse having an insulating casing including a pair of coaxial spaced walls defining a space of annular cross-section therebetween housing fusible elements and a pulverulent arc-quenching filler, and annular terminal means closing the ends of said casing of said fuse, and one of said terminal means being formed by said second fixed annular contact of said load-break disconnect.

* * * * *